United States Patent [19]

Chillier-Duchatel et al.

[11] 4,061,554

[45] Dec. 6, 1977

[54] ELECTROCHEMICAL METHOD FOR PRODUCING OXYGEN

[75] Inventors: Nicole Chillier-Duchatel, Sevres; Bernard Verger, Chevreuse, both of France

[73] Assignee: Societe Generale de Constructions Electriques et Mecaniques "Alsthom et Cie", Paris, France

[21] Appl. No.: 676,751

[22] Filed: Apr. 14, 1976

[30] Foreign Application Priority Data

Apr. 24, 1975 France ..... 50.12848

[51] Int. Cl.[2] ..... C25B 1/02

[52] U.S. Cl. ..... 204/129

[58] Field of Search ..... 204/129

[56] References Cited

U.S. PATENT DOCUMENTS 1,891,974 12/1932 Fischer ..... 204/129

*Primary Examiner*—R. L. Andrews

*Attorney, Agent, or Firm*—Flynn & Frishauf

[57] ABSTRACT

Method for preparing very pure oxygen, consisting in making air in a basic medium react with the reduced form of a compound so as to form a peroxide which is capable of decomposing spontaneously into hydrogen peroxide and into the oxidized form of the said compound, and electrochemically oxidizing said hydrogen peroxide to evolve oxygen, and reducing the said oxidized form to regenerate the reduced form of the said compound. The invention is implemented in the chemical industry.

12 Claims, 2 Drawing Figures

ELECTROCHEMICAL METHOD FOR PRODUCING OXYGEN

The present invention has as its object an electrochemical method for producing oxygen.

The method for producing oxygen by electrolysis of water is well-known.

Such a method requires a great consumption of electric energy and, moreover, the oxygen produced always contains a small quantity of hydrogen. In the case where it is required to obtain pure oxygen, it is therefore necessary to remove the hydrogen therefrom, for example by making the oxygen pass through a porcelain tube lined with fragments of that same material in a red hot state and in which the hydrogen is transformed into a small quantity of water.

Moreover, in the electrolysis of water, the concomittant production of hydrogen sets quite serious safety problems.

The present invention makes it possible to overcome the disadvantages of known methods and it has as its object an electrochemical method suitable for producing very pure oxygen at a moderate cost price, having very great reliability.

It also concerns a device for implementing such a method.

The object of the invention is therefore an electrochemical method for producing oxygen, characterized in that, successively: air in a basic medium is made to act upon the reduced form of a compound so as to form a peroxide which is capable of decomposing spontaneously into hydrogen peroxide and into the oxidised form of the said compound; the electrochemical oxidising of the said hydrogen peroxide is effected in such a way that the oxygen is evolved; the electrochemical reducing of the said oxidised form is effected so as to regenerate the said reduced form of the compound.

The invention also has as its object a device for implementing the said method, characterized in that it comprises:

an enclosure called an oxidising reactor, in which air oxidises the reduced form of the said compound so as to form a peroxide which is capable of decomposing spontaneously into hdyrogen peroxide and into the oxidised form of the said compound;

an electrolyser comprising an anode and a cathode separated by a semi-permeable membrane or diaphragm defining an anode compartment and a cathode compartment, the said anode compartment receiving the said hydrogen peroxide and the said oxidised form of the compound and being suitable for chemically oxidising hydrogen peroxide in such a way that oxygen is evolved, the said cathode compartment receiving the said oxidised form of the compound and being suitable for effecting its electrochemical reduction in such a way that the said reduced form of the compound be regenerated.

To great advantage, the said electrolyser is formed by several bipolar electrodes separated from one another by diaphragms, the assembly constituting a structure of the filter-press type.

Figure 1:
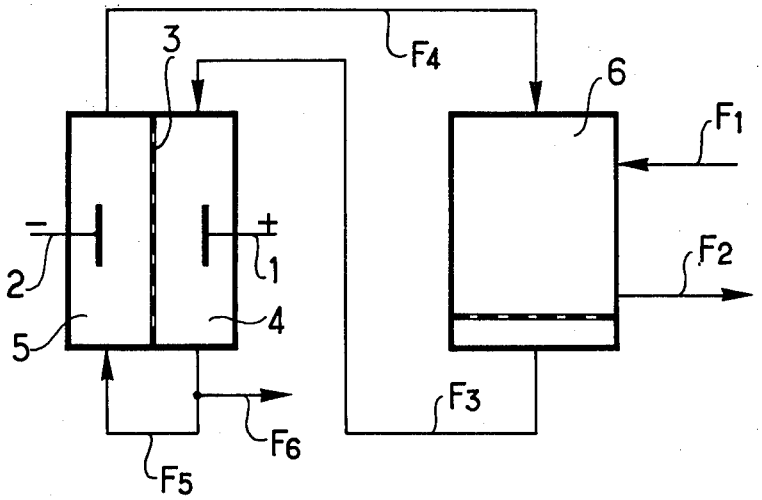
Figure 2:
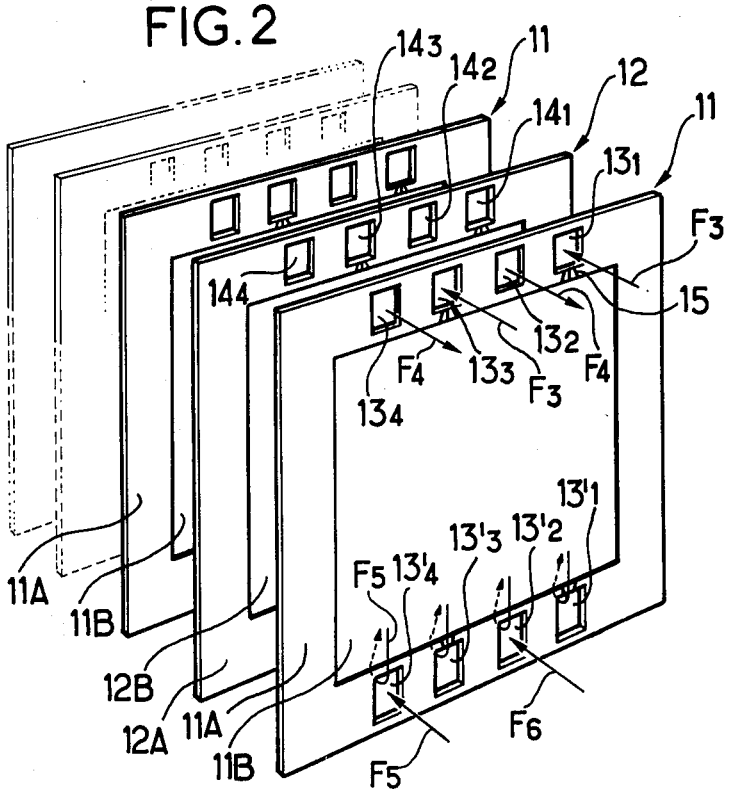

Other characteristics and advantages of the invention will become apparent from the following description, given by way of an illustrating example having no limiting character, with reference to the accompanying drawings and diagrams, in which:

FIG. 1 shows diagrammatically a device making it possible to explain clearly the method according to the invention, FIG. 2 shows diagrammatically a device or electrolyser of the filter-press type for implementing the method according to the invention.

It is known that certain substances and, more particularly, anthraquinonic and alkylanthraquinonic derivatives in reduced form can give, with the oxygen in the air, a particularly oxidising peroxide form, which, spontaneously forms hydrogen peroxide and the oxidised form by decomposition.

Moreover, the derivatives of anthraquinone can be chemically reduced particularly well.

The applicant therefore had conceived the idea of implementing such substances in an electrolyser to reduce the oxidised form therein, that oxidised form subsequently being peroxidised in a reactor, where it decomposes spontaneously into the oxidised form and into hydrogen peroxide, the latter substance being oxidised electrochemically in the electrolyser to give pure oxygen.

Consequently, FIG. 1 shows diagrammatically an electrolyser comprising an anode 1, a cathode 2, separated by a semi-permeable membrane o diaphragm 3 defining an anode compartment 4 and a cathode compartment 5.

The reference 6 designates an oxidation enclosure or reactor supplied, in the direction of the arrow F1, with air, the said reactor containing a derivative which can be transformed into a peroxide, that derivative possibly being of the anthraquinonic type, for example anthraquinone 2-7 sodium or lithium disulphonate or a disulphonate of another alkali metal. The air depleted of oxygen is removed from the reactor in the direction of the arrow F2.

That reactor supplies the anode compartment 4 of the electrolyser in the direction of the arrow F3 and it receives, in the direction of the arrow F4, the products coming from the cathode compartment 5.

Moreover, the anode compartment 4 and the cathode compartment 5 communicate together, as shown by the arrow F5, the arrow F6 showing the direction of removal of the oxygen produced by such an electrolyser.

The electrolyte is an aqueous solution of an alkali hydroxide such as potassium hydroxide, lithium hydroxide or the like. The method according to the invention can be described as follows: in the reactor 6, the reduced form of the anthraquinonic derivative coming, as shown by the arrow F4, from the cathode compartment 5 of the electrolyser, produces, with the air conveyed in the direction of the arrow F1, a peroxide which decomposes spontaneously into hydrogen peroxide and into the oxidised form of the said anthraquinonic derivative. Those latter two substances are therefore conveyed in the direction of the arrow F3 into the anode compartment 4, where the hydrogen peroxide is oxidised electrochemically into water. The resulting oxygen is removed in the direction of the arrow F6.

The said oxidised form then flows, in the direction of the arrow F5, into the cathode compartment F5, in which it is reduced. The reduced form is then directed towards the reactor 6 in the direction of the arrow F4 and so on.

The following reactions make it possible to illustrate the reactional process:

The cathode compartment 5 contains:

Oxidised form + 2 $H_2O$ + 2$e$ . . . Reduced form + 20H—

The reactor contains:

Reduced form + $O_2$ . . . Oxidised form + $H_2O_2$

The anode compartment 4 contains:

$H_2O_2$+ 2 OH— . . . O2 + 2 $H_2O$ + 2$e$

Of course, the difference in potential applied between the electrodes 1 and 2 of the electrolyser is substantially equal to the difference between the oxide-reducing potential of the anthraquinonic derivative and the hydrogen peroxide electrochemical oxidation potential.

In the example described, that potential is 0.23 volts, approximately.

FIG. 2 shows an electrolyser of the filter-press type suitable for implementing the method according to the invention. Such an electrolyser is formed by several components having substantially identical dimensions, namely, a bipolar electrode 11, a bipolar separator or diaphragm 12, a bipolar electrode 11 and so on.

Each of those components is formed by a frame 11A, 12A surrounding a central part 11B, 12B.

One of the faces of each bipolar electrode, for example, the face which is shown in the figure, fulfills the function of an anode, whereas the other face constitutes the cathode. The said faces can, to great advantage, comprise catalytic compounds specific to the reactions which take place at their level.

Moreover, the frames 11A, 12A comprise upper openings $\mathbf{13}_i$, $\mathbf{14}_i$ and lower openings $\mathbf{13'}_i$, $\mathbf{14'}_i$ ($i$ = 1, 2, 3 . . . ) forming, when the components are set tight against one another so as to constitute the filter-press assembly, channels.

Thus, the openings $\mathbf{13}_1$ and $\mathbf{13}_3$ of the electrodes 11 ensure the irrigation (washing) of the anode faces with hydrogen peroxide and with the oxidised form of the anthraquinonic derivative (arrow F3, FIG. 1), whereas the openings $\mathbf{13'}_1$ to $\mathbf{13'}_4$ have the function of transferring, on the one hand, the oxidised form, more particularly on the cathode face of the electrodes (arrows F5, FIG. 1) and on the other hand, the oxygen evolved towards the outside (arrow F6, FIG. 1).

Inasmuch as concerns the openings $\mathbf{13}_2$ and $\mathbf{13}_4$, they have the function of collecting the reduced form formed on the cathode face (arrow F4, FIG. 1) and of transferring it towards, the reactor 6 (FIG. 1, not shown in FIG. 2). The putting into communication of the above described openings with the corresponding face is ensured, for example, by means of micro-channels such as 15.

The method and the device according to the invention therefore make it possible to obtain very pure oxygen with a minimum consumption of electric energy, in an exclusive manner, that is, without any secondary production of an element such as hydrogen, which causes a permanent danger of explosion despite the strict safety regulations imposed.

It must be understood that the invention is in no way limited to the embodiment described and illustrated, which has been given only by way of an example.

More particularly, without going beyond the scope of the invention, details can be modified, certain arrangements can be changed or certain means can be replaced by equivalent means.

Likewise, it is quite evident that compounds other than anthraquinonic derivatives, suitable for producing hydrogen peroxide in contact with air, can be used, without forasmuch going beyond the intent of the invention.

What is claimed is:

1. Electrochemical method for producing oxygen, comprising successively:

reacting air in a basic medium with the reduced form of the anthraquinone 2–7 disulphonate of an alkali metal to form a peroxide which spontaneously decomposes into (i) hydrogen peroxide and (ii) the oxidised form of said anthraquinone;

electrochemically oxidising said hydrogen peroxide to form oxygen;

recovering said oxygen;

electrochemically reducing said oxidised form of said anthraquinone to regenerate said reduced form of said anthraquinone; and recycling said reduced form, to react with said air.

2. Method according to claim 1, wherein said alkali metal is sodium.

3. Method according to claim 2, wherein said alkali metal is lithium.

4. Method according to claim 3, wherein said basic medium is an aqueous solution of potassium hydroxide.

5. Method according to claim 4, characterized in that the said oxidation and the said electrochemical reduction are effected at a difference in potential equal to the difference between the oxide reduction potential of the said anthraquinone and the electrochemical oxidation potential of hydrogen peroxide.

6. Method according to claim 2, wherein said basic medium is an aqueous solution of potassium hydroxide.

7. Method according to claim 6, characterized in that the said oxidation and the said electrochemical reduction are effected at a difference in potential equal to the difference between the oxide reduction potential of the said anthraquinone and the electrochemical oxidation potential of hydrogen peroxide.

8. Method according to claim 6, wherein the mixture of hydrogen peroxide and the oxidized form of said anthraquinone formed by said spontaneous decomposition is positioned in an anode compartment of an electrochemical cell wherein said hydrogen peroxide is electrochemica-ly oxidized.

9. Method according to claim 1, wherein said basic medium is an aqueous solution of an alkaline hydroxide.

10. Method according to claim 1, characterized in that the said oxidation and the said electrochemical reduction are effected at a difference in potential equal to the difference between the oxide reduction potential of the said anthraquinone and the electrochemical oxidation potential of hydrogen peroxide.

11. Method according to claim 1, wherein said basic medium is an aqueous solution of potassium hydroxide.

12. Method according to claim 1, wherein the mixture of hydrogen peroxide and the oxidized form of said anthraquinone formed by said spontaneous decomposition is positioned in an anode compartment of an electrochemical cell wherein said hydrogen peroxide is electrochemically oxidized.

* * * * *